US011293456B2

(12) United States Patent
De Filippis

(10) Patent No.: US 11,293,456 B2
(45) Date of Patent: Apr. 5, 2022

(54) ELECTRIC PUMP

(71) Applicant: SPAL AUTOMOTIVE S.r.l., Correggio (IT)

(72) Inventor: Pietro De Filippis, Varazze (IT)

(73) Assignee: SPAL AUTOMOTIVE S.R.L., Corregio (IT)

( * ) Notice: Subject to any disclaimer, the term of this patent is extended or adjusted under 35 U.S.C. 154(b) by 188 days.

(21) Appl. No.: 16/500,297

(22) PCT Filed: Apr. 6, 2018

(86) PCT No.: PCT/IB2018/052398

§ 371 (c)(1),
(2) Date: Oct. 2, 2019

(87) PCT Pub. No.: WO2018/185719

PCT Pub. Date: Oct. 11, 2018

(65) Prior Publication Data

US 2020/0063756 A1 Feb. 27, 2020

(30) Foreign Application Priority Data

Apr. 7, 2017 (IT) ..... 102017000038666

(51) Int. Cl.
*F04D 1/06* (2006.01)
*F04D 13/06* (2006.01)
*F04D 29/58* (2006.01)

(52) U.S. Cl.
CPC ..... *F04D 29/58* (2013.01); *F04D 1/06* (2013.01); *F04D 13/06* (2013.01)

(58) Field of Classification Search
CPC ..... F04D 1/06; F04D 13/06; F04D 29/58
(Continued)

(56) References Cited

U.S. PATENT DOCUMENTS 6,663,362 B1 12/2003 Lentz et al.
6,903,471 B2 * 6/2005 Arimitsu ..... H02K 3/24 310/59

(Continued)

FOREIGN PATENT DOCUMENTS

CN 101336506 A 12/2008
CN 103261705 A 8/2013

(Continued)

OTHER PUBLICATIONS

International Search Report and Written Opinion dated Jun. 20, 2018 from counterpart PCT App No. PCT/IB2018/052398.

(Continued)

*Primary Examiner* — Connor J Tremarche
(74) *Attorney, Agent, or Firm* — Shuttleworth & Ingersoll, PLC; Timothy Klima

(57) ABSTRACT

An electric liquid pump includes a casing having a central portion, rear cover and front cover, having an inlet and an outlet for the liquid. The central portion has first and second compartments, with the second compartment in fluid communication with the front cover interior. The pump includes an impeller and an electric motor, for operating the impeller, a stator housed in the first compartment, a rotor, coaxial with the stator, housed in the second compartment and an electronic card for supplying the stator at least partly housed in the rear cover. The central portion includes a plurality of walls delimiting a plurality of gaps in fluid communication with the second compartment and the front cover interior such that the liquid circulates in the gaps. The walls at least partly face the stator such that the liquid circulating in the corresponding gap removes heat from the stator.

13 Claims, 7 Drawing Sheets

(58) Field of Classification Search
USPC ..... 417/423.1
See application file for complete search history.

(56) References Cited

U.S. PATENT DOCUMENTS

| | | | | |
|---|---|---|---|---|
| 7,819,640 | B2 | 10/2010 | Kalavsky et al. | |
| 9,391,493 | B2 | 7/2016 | Leung et al. | |
| 2003/0124002 | A1 | 7/2003 | Oliveira et al. | |
| 2008/0118380 | A1* | 5/2008 | Nakanishi | F04D 29/5813 417/423.1 |
| 2009/0022610 | A1 | 1/2009 | Materne et al. | |
| 2013/0259720 | A1* | 10/2013 | Mills | F04D 13/06 417/410.1 |
| 2017/0205063 | A1* | 7/2017 | Kadijk | F21V 29/70 |

FOREIGN PATENT DOCUMENTS

| | | | |
|---|---|---|---|
| CN | 10595652 | | 7/2016 |
| CN | 105782064 | A | 7/2016 |
| WO | 2012024778 | A1 | 3/2012 |
| WO | 2016033667 | A1 | 3/2016 |

OTHER PUBLICATIONS

Chinese Office Action dated May 21, 2020 from counterpart Chinese Patent Apploication No. 110475975.

* cited by examiner

ELECTRIC PUMP

This application is the National Phase of International Application PCT/IB2018/052398 filed Apr. 6, 2018 which designated the U.S.

This application claims priority to Italian Patent Application No. 102017000038666 filed Apr. 7, 2017, which application is incorporated by reference herein.

TECHNICAL FIELD

This invention relates to an electric pump and in particular an electric pump for moving liquid for example in the systems for cooling the engine or heating the passenger compartment in the vehicles in general.

BACKGROUND ART

Numerous solutions for electric pumps are known in the prior art comprising, schematically, an electric motor, an impeller connected to the rotor of the motor for moving the liquid, a cover of the impeller equipped with conduits for inlet and outlet of the liquid and a rear cover, positioned on the opposite side of the impeller relative to the motor, in which, in many applications, the control electronics of the motor are housed.

Of particular interest for this application are the so-called "wet rotor" electric pumps in which the rotor is confined in a space in which the liquid moved by the impeller also passes; examples of these pumps are described, for example, in patent documents U.S. Pat. Nos. 6,663,362 and 7,819,640.

In these solutions, the liquid inside the motor also removes part of the heat generated from the stator during operation; however, the performance, in terms of cooling of the pump, is not satisfactory given the high operating temperatures.

More specifically, the prior art solutions do not guarantee an efficient cooling of the stator windings and the control electronics of the motor which, especially for particularly high powers, reach equally relatively high temperatures.

AIM OF THE INVENTION

In this context, the main purpose of this invention is to provide an electric pump which overcomes the above-mentioned drawbacks.

One aim of this invention is to provide an electric pump wherein the stator windings and the control electronics are effectively cooled.

Another aim of this invention to provide an electric pump which is compact and easy to assemble.

These aims are fully achieved by an electric pump having the features as disclosed herein.

In accordance with a first aspect, this invention relates to an electric pump for moving a liquid intended in particular to automobile applications.

The pump comprises a casing formed by a rear cover, a front cover joined to a central portion, having a first and a second compartment which are separate from each other.

The front cover comprises an inlet and an outlet for the liquid moved by the pump.

The pump comprises an electric motor comprising a stator having a plurality of poles housed in the first compartment, a rotor, coaxial with the stator, housed in the second compartment and an electronic card for supplying the motor at least partly housed in the rear cover.

The second compartment is in fluid communication with the inside of the front cover, so is also filled with the liquid moved by the pump. The pump is a so-called wet rotor pump since the rotor moves in the second flooded compartment.

The pump comprises an impeller associated with the rotor, rotated by the latter and housed at least partly in the front cover.

According to one embodiment, the impeller is moulded as one with the rotor, preferably made of plastic material.

According to one aspect of this invention, the central portion of the pump is shaped in such a way as to have a plurality of gaps for the passage of the liquid moved by the pump in such a way that it can also remove at least part of the heat generated by the motor during its operation.

According to an embodiment, the central portion of the casing comprises a plurality of walls delimiting a plurality of gaps in fluid communication with the second compartment and/or with the inside of the front cover.

The walls are at least partly facing the stator and/or the relative poles in such a way that the liquid circulating in the corresponding gap removes heat from the stator.

According to one aspect of this invention, the pump comprises a first annular wall, which externally delimits part of the casing, and a second annular wall delimiting with the first annular wall an annular gap surrounding at least partly the stator.

The second inner annular wall is further inside than the first annular wall.

The annular gap is in fluid communication with the second compartment and/or with the inside of the front cover in such a way that the liquid moved by the pump can circular in the annular gap.

According to one aspect of this invention, the central portion of the pump comprises at least one seat for at least one pole of the stator. In practice, the compartment for housing the stator comprises at least one seat for at least one pole of the stator.

In one embodiment, the seat is delimited by a first side wall, by a second side wall, by a third side wall, by a fourth side wall and by a bottom wall.

The seat for at least one pole at least partly defines the first compartment. In this way, the walls of the seat constitute a heat exchange surface between the stator windings and the liquid which is in contact with the walls on the opposite side relative to the stator.

In one embodiment, in order to maximise the heat exchange surface, the central portion comprises a plurality of seats each for a corresponding pole of the stator.

Each seat is delimited by a respective first side wall, a second side wall, a third side wall transversal to the first two, a fourth side wall parallel to the third side wall, and radially spaced from it, and by a bottom wall from which the side walls extend.

According to one aspect of the invention, the side walls extend from the bottom wall according to an axial direction, that is, parallel to the axis of rotation of the motor.

The set of the seats at least partly defines the first compartment, that is, the stator is substantially housed in the first compartment with the poles in corresponding seats.

According to one aspect of this invention, gaps in which the liquid passes removing heat are defined between adjacent seats.

The gaps between the adjacent seats extend mainly in an axial direction and in a radial direction, considering the axis of rotation of the motor, between the poles of the stator.

In practice, the first side wall of a first seat and the second side wall of a radial second seat adjacent to the first seat delimit a radial gap in fluid communication with the second compartment.

According to one aspect of this invention, the so-called radial gaps are located between adjacent poles of the stator in such a way as to remove heat from them.

According to one aspect of this invention, the third side walls of the seats delimit at least in part the second compartment.

The third side walls are positioned in the air gap of the electric motor between the stator and the rotor.

According to one aspect of this invention, the central portion comprises a first annular wall, which externally delimits the casing, which delimits, with the fourth side wall of the seats, a gap which surrounds, at least partly, the stator and in fluid communication with the second compartment and with the inside of the front cover.

According to one aspect of this invention, the succession of the fourth side walls defines a discontinuous internal annular wall which delimits with the first annular wall of the casing a channel for passage of the liquid moved by the pump.

According to another aspect of this invention, to remove heat also from the electronic card of the motor, the central portion comprises a disc-shaped wall defining a bottom wall of the second compartment.

The electronic card is abutted against the disc-shaped wall on the opposite side of the disc-shaped wall relative to the rotor.

Ibn order to maximise the heat exchange between the card and the disc-shaped wall, the pump comprises a thermally conductive filler material interposed between the electronic card and the disc-shaped wall.

The filler material may comprise, for example, the so-called gap-filler or heat conductive silicone.

According to one aspect of this invention, a thermally conductive material, which may comprise, for example, the so-called gap-filler or heat conductive silicone is positioned between the stator and the central portion of the casing where the stator is housed; in this way, the heat exchange surface is maximised between the stator and casing, the walls of which, as indicated, are touched, on the side opposite the stator, by the liquid moved by the pump.

The central portion of the pump, which may have a relatively complex shape for maximising the heat exchange surfaces, is preferably made of plastic material by moulding.

A plastic material preferably used is polyphenylene sulphide PPS with, for example, graphite or ceramic fillers so as to have appreciable thermal conductivity.

Generally speaking, according to one aspect of this invention, at least the central portion of the casing is made of plastic material having an average thermal conductivity in the order of 10 W/(m·° K).

BRIEF DESCRIPTION OF THE DRAWINGS

Other features and advantages of the invention are more apparent in the detailed description below, with reference to a non-limiting and non-exclusive preferred embodiment of an electric pump, as illustrated in the accompanying drawings, in which.

DETAILED DESCRIPTION OF PREFERRED EMBODIMENTS OF THE INVENTION

Figure 1:
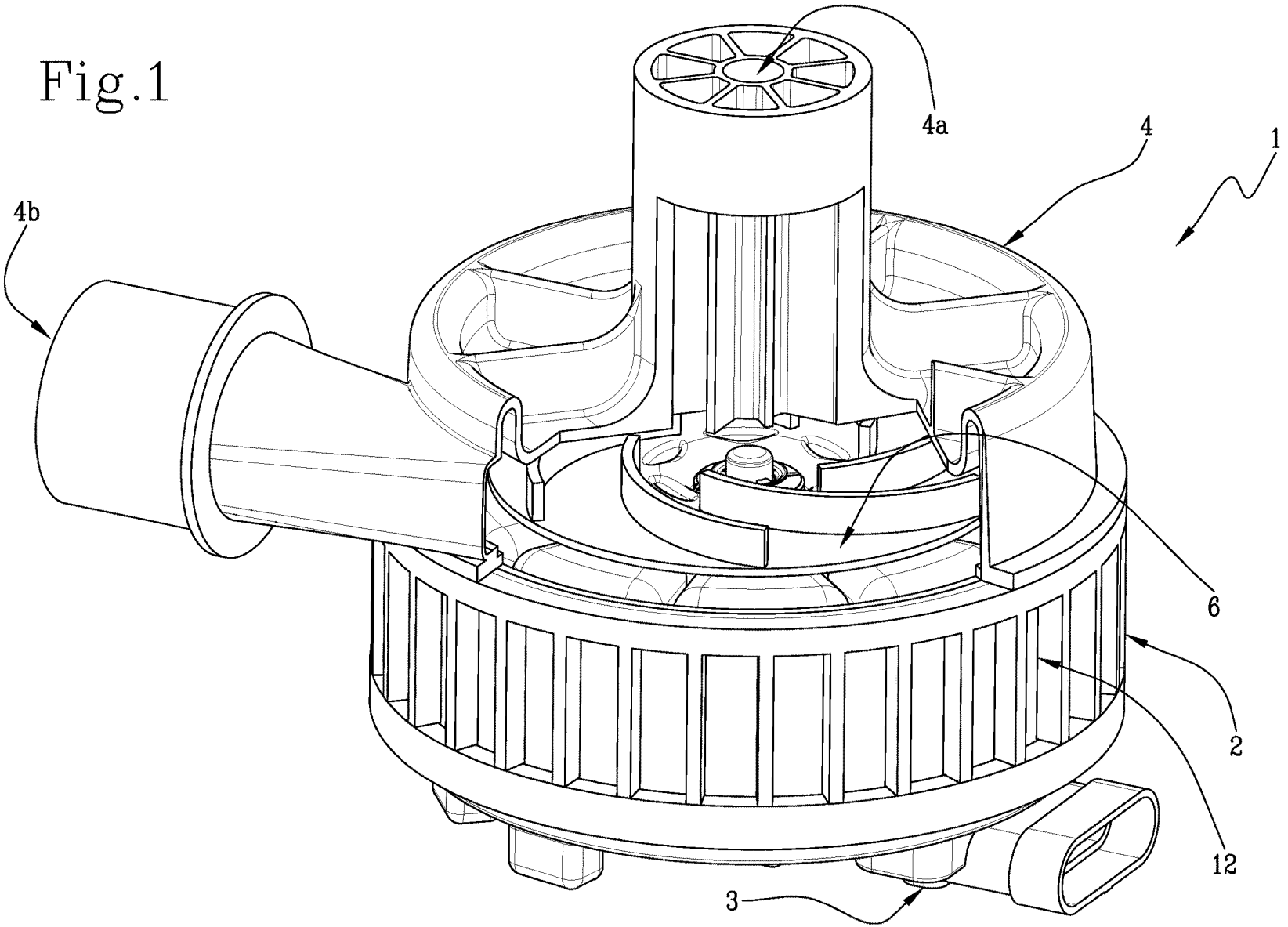
FIG. 1 is a schematic perspective view of an electric pump according to this invention.

With reference in particular to FIG. 1, the numeral 1 denotes an electric pump according to this invention.

The pump 1 comprises a casing comprising, in the example illustrated, a central portion 2, a rear cover 3 and a front cover 4 closing the portion 2 to form a closed casing.

The front cover 4 is of substantially known type, for example made of plastic material, and is coupled in a sealed fashion to central portion 2 and has an inlet and an outlet for the liquid moved by the pump 1.

The cover 3 is also joined to the central portion 2 in substantially known manner in such a way as to define the above-mentioned casing of the pump 1; the cover 3 may be made, for example, of aluminium.

The inside of the casing is fitted with an electric motor 5, having an axis R of rotation, which rotates an impeller 6 which is substantially positioned inside the cover 4.

The motor 5 is of a brushless type with permanent magnets of substantially known type and therefore described only insofar as necessary for understanding this invention.

The motor 5 comprises a wound stator 7, equipped with a plurality of poles 7*a*, and a rotor 8; for simplicity, reference is made below to the poles 7*a* meaning both the ferromagnetic material and the corresponding winding.

The rotor 8 is preferably made of plastic co-moulded with the magnets and also forms the impeller in the preferred embodiment illustrated by way of example.

In practice, the impeller 6 is preferably made in a single piece with the rotor 8 of the motor 5.

The motor is of the so-called wet rotor type since the liquid moved by the pump, and in particular by the impeller 6, also wets, as described in more detail below, the rotor 8.

The motor 5 comprises an electronic card 9 or electronic module for controlling the motor itself housed, in the example illustrated, inside the casing of the pump 1; in one embodiment, the electronic card 9 is substantially positioned in the rear cover 3.

Figure 2:
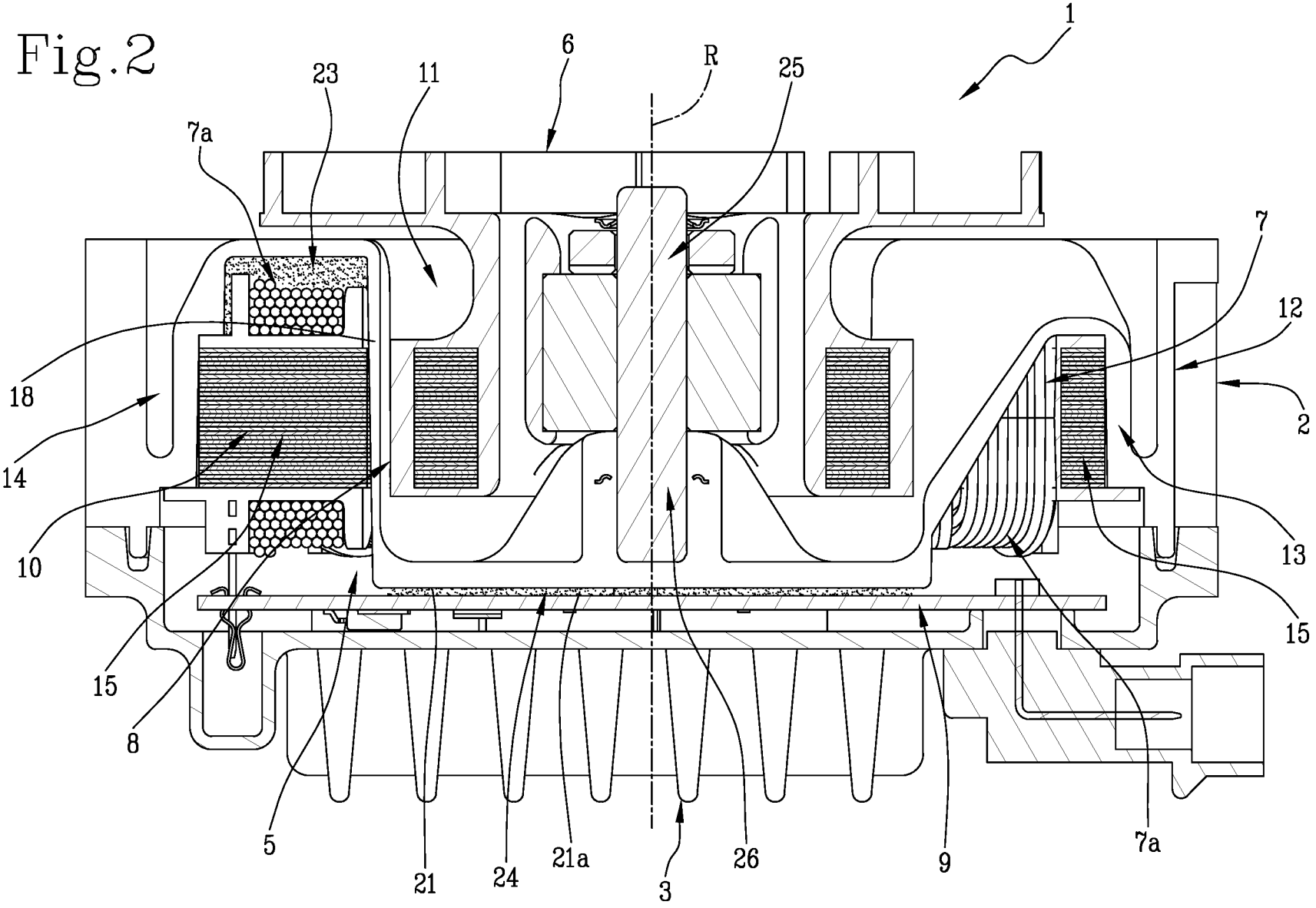
FIG. 2 is a schematic cross section of the pump of FIG. 1.
Figure 3:
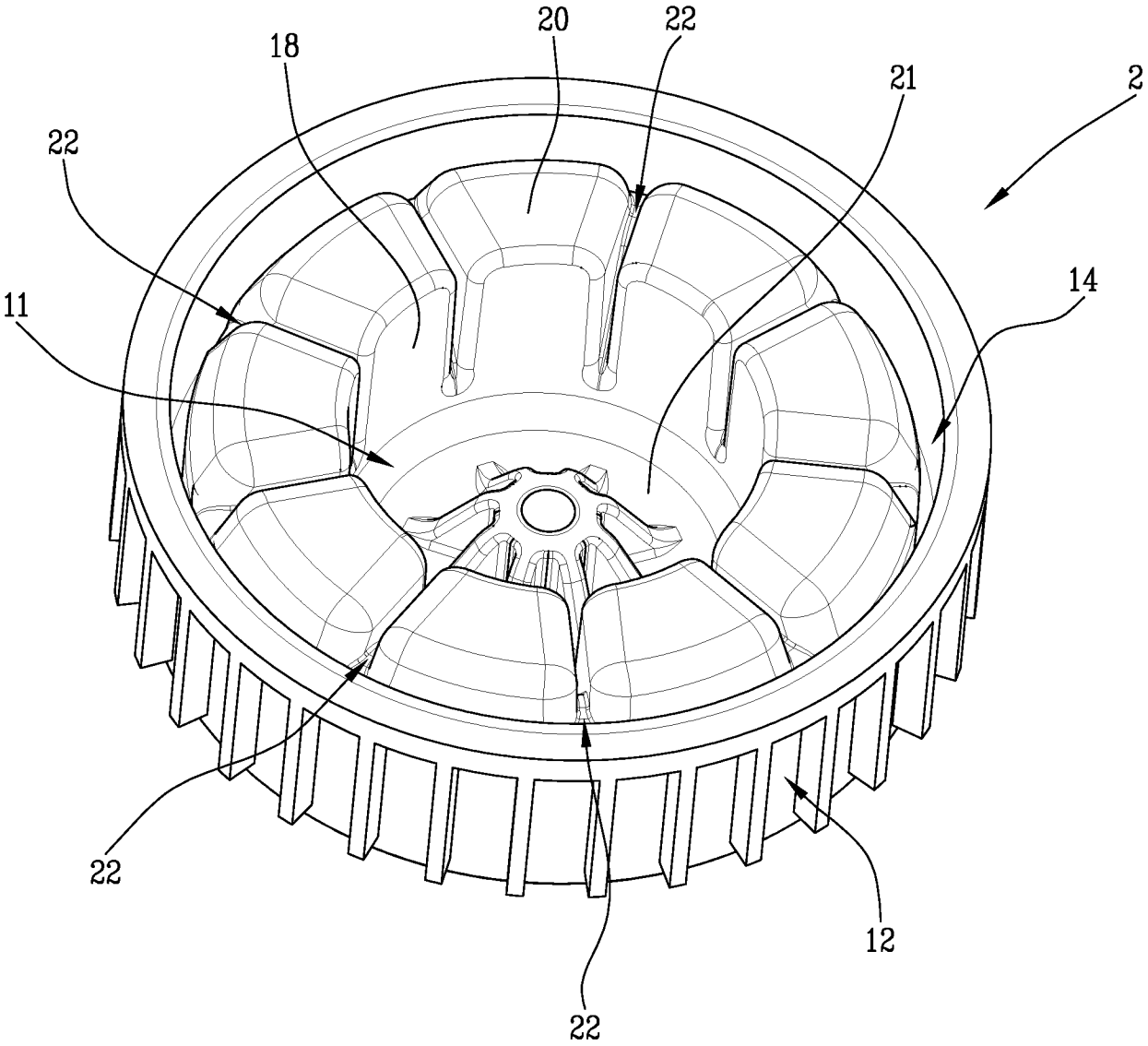
FIG. 3 is a first schematic perspective view of a detail of the pump of the preceding drawings.
Figure 4:
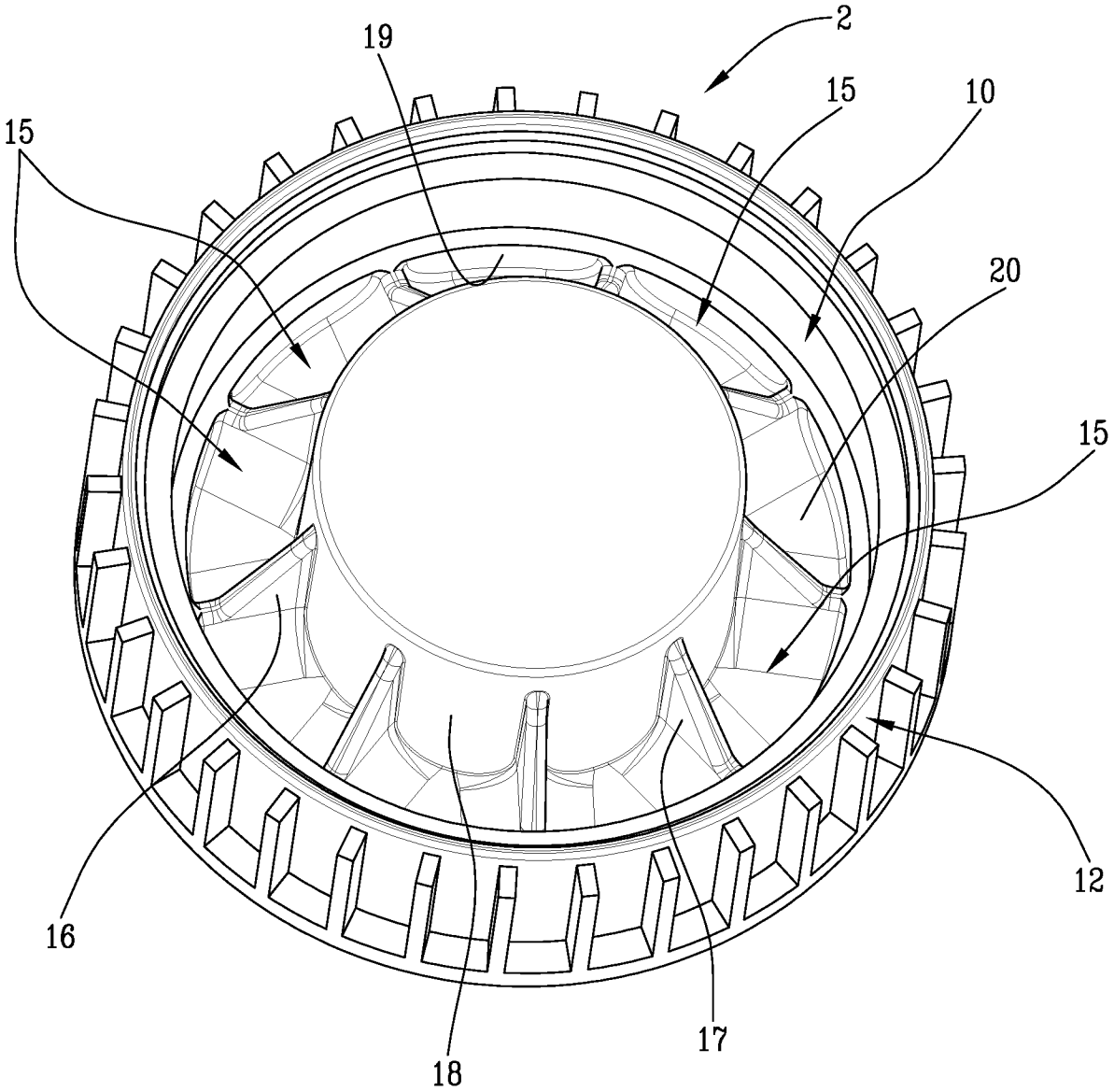
FIG. 4 is a second schematic perspective view of the detail of FIG. 3.
Figure 6:
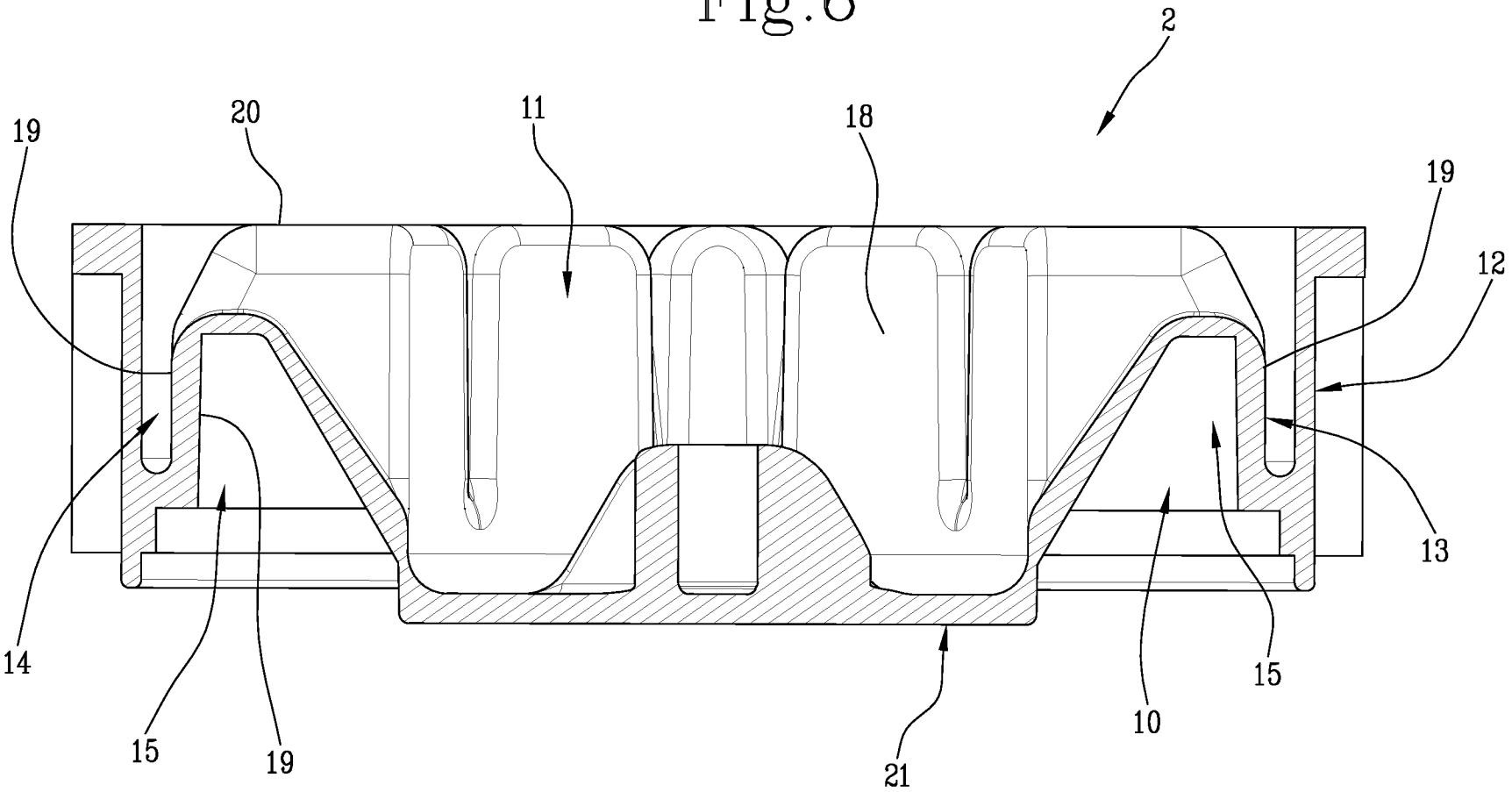
FIG. 6 is a schematic cross-section of the detail of FIGS. 3 to 5 through the plane VI-VI of FIG. 5.

As illustrated, in particular in FIGS. 2, 4 and 6, the central portion 2 has a first compartment 10 for housing the stator 7.

As illustrated, in particular in FIGS. 2, 3, 5 and 6, the central portion 2 has a second compartment 11 for housing the rotor 8 in fluid communication with the inside of the front cover 4.

The first and the second compartment 10, 11 are separated from one another as the stator must remain isolated from the liquid moved by the pump 1.

In one embodiment, the first and the second compartments 10, 11 have concavities facing opposite sides.

Preferably, the first compartment 10 has the concavity facing towards the rear cover 3.

Preferably, the second compartment 11 has the concavity facing towards the front cover 4.

In one embodiment, the first and the second compartments 10, 11 extend in such a way as to be coaxial with the first compartment 10 which surrounds the second compartment 11.

The central portion 2 comprises a plurality of walls delimiting the compartments 10 and 11 as described in further detail below.

The walls define or delimit a plurality of gaps in fluid communication with the compartment 11 and with the inside of the front cover 4 in such a way as to be affected by the passage of liquid moved by the pump 1.

In a preferred embodiment, the above-mentioned walls are at least partly facing the stator 7 or parts of it in such a way that the liquid circulating in the corresponding gap removes heat from the stator 7.

The central portion 2 is made of plastic material by moulding, also in such a way that it can be shaped in an advantageous manner for cooling the electric motor.

Preferably, the portion 2 is made of polyphenylene sulphide PPS with a filler to obtain a good electrical insulation which does not disturb, in particular, the magnetic fields of operation of the motor 5, and a good thermal conductivity.

According to a first example, the central portion 2 is made of polyphenylene sulphide PPS with graphite filler.

According to a second example, the central portion 2 is made of polyphenylene sulphide PPS with ceramic filler.

In general, the central portion 2 is preferably made of a plastic material having an average thermal average conductivity in the order of 10 W/(m·° K).

Looking in more detail with respect to an example embodiment of the central portion 2, it should be noted that the central portion 2 comprises a first annular wall 12, which externally delimits part of the casing.

The portion 2 comprises a second annular wall 13, or inner annular wall, which delimits, with the wall 12, an annular gap 14.

The gap 14 surrounds, at least partly, the stator 7 and is in fluid communication with the compartment 11 and with the inside of the front cover 4.

In one embodiment, the wall 13 can be discontinuous and delimit further gaps; in this case, the gap 14 is also discontinuous.

In an embodiment illustrated by way of example, the central portion 2 has a plurality of seats 15 each for a corresponding pole 7*a*, with the corresponding reel, of the stator 7.

The seats 15 define, at least partly, the compartment 10, in the sense that the stator 7 is housed, at least partly, in the seats 15.

Each seat 15 is delimited by a respective first side wall 16, a second side wall 17, a third side wall 18, a fourth side wall 19 and a bottom wall 20 joined to each other.

The walls 16, 17, 18 and 19 extend from the bottom wall 20 towards the rear cover 3.

The walls 16, 17, 18 and 19 extend from the bottom wall 20 along a direction parallel to the axis R of rotation of the motor 5.

The walls 18 and 19 are parallel and spaced from each other along a radius of the motor 5.

The walls 16 and 17 connect the walls 18 and 19 and define, together with the bottom wall 20, a cup-shaped structure.

The walls 16, 17, 18, 19 and 20 of each seat 15 fit around the corresponding pole 7*a* of the stator 7.

The walls 16, 17, 18, 19 and 20 also delimit, at least partly, the compartment 11.

The central portion 2 comprises a bottom wall 21, from which extend the side walls 18 of the seats 15.

The walls 18 are, as illustrated, positioned in the air gap of the electric motor 5.

According to this invention, the first side wall 16 of a first seat 15 and the second side wall 17 of a second seat 15 adjacent to the first seat delimit a corresponding gap 22 in fluid communication with the compartment 11.

Figure 5:
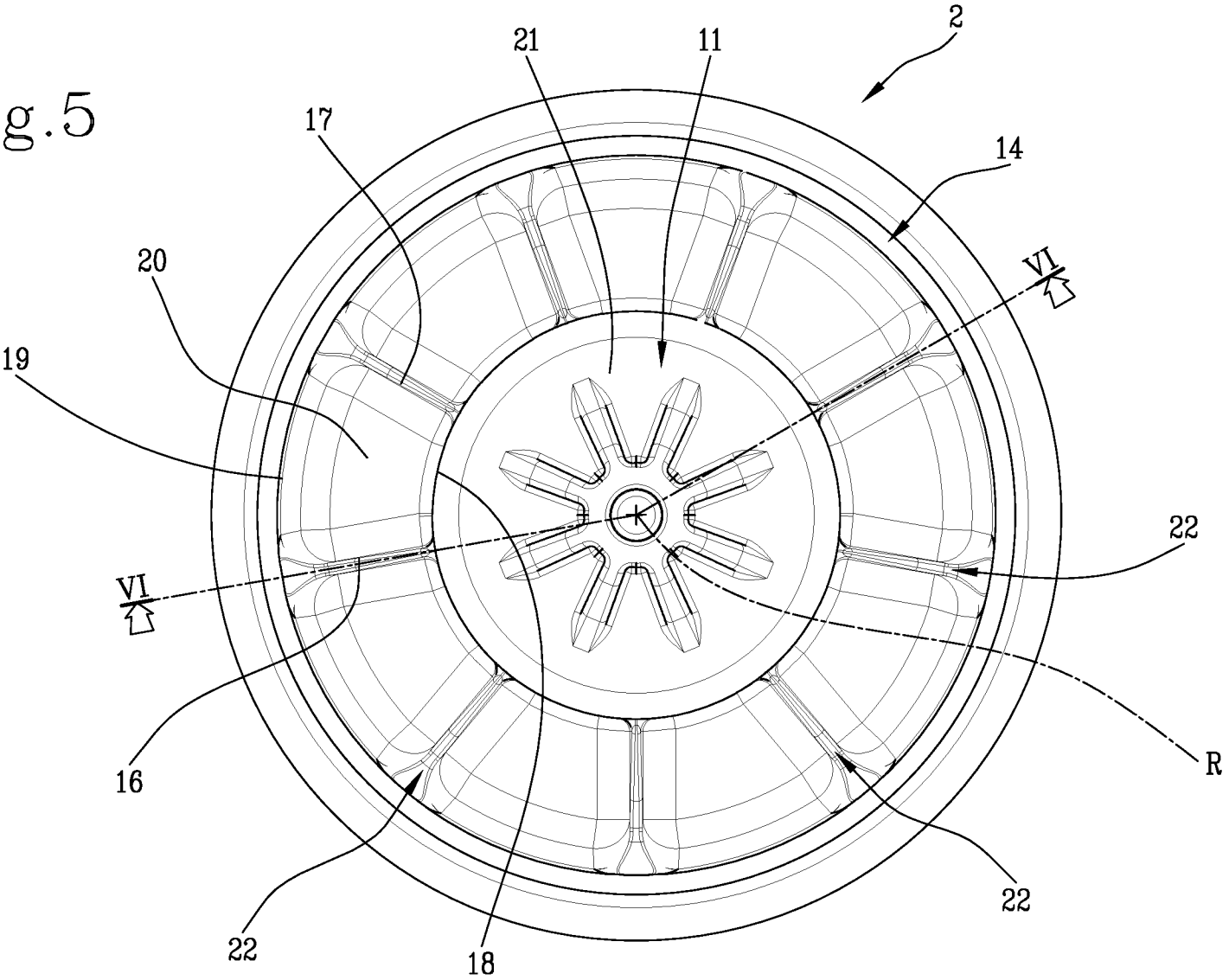
FIG. 5 is a plan view of the detail of FIGS. 3 and 4.

The gaps 22, defined between adjacent walls 16 and 17, extend, with particular with reference to FIG. 5, in a radial direction.

The gaps 22, defined between adjacent walls 16 and 17, extend mainly between consecutive poles 7*a*.

Each pole 7*a* of the stator is surrounded by a pair of gaps 22.

In the embodiment illustrated, the side walls 19 of the seats 15 contribute to the definition of the annular wall 13 and, therefore, of the gap 14.

Considering the full axial extension of the gap 14, the gap has a continuous part, located towards the cover 3, and a discontinuous part in fluid communication with the gaps 22.

The gap 14 surrounds the stator 7 for the full axial extension of the portion 2 of the casing.

In the embodiment illustrated, the liquid moved by the impeller 6 touches all the walls 16-20 delimiting the seats 15 and also the bottom wall 21 of the compartment 11.

Since the portion 2 is preferably made of thermally conductive plastic material, the liquid removes heat from the portion 2.

In order to maximise the heat exchange surface between the stator 7 and the central portion 2 of the pump 1 comprises a thermally conductive filler material 23 interposed between the stator 7 and the central portion 2.

The material 23 is, for example, placed in the seats 15 before inserting the stator 7 in such a way as to define a thermal continuity between the stator 7 and the portion 2.

In fact, the stator 7 does not have regular surfaces, for example at the windings, and the material 23 maximises the contact surfaces.

In the preferred embodiment illustrated, the above-mentioned electronic card 9 is abutted against the wall 21 on the opposite side relative to the rotor 8.

The wall 21 has a flat face 21*a* on the opposite side relative to the rotor 8, for maximising the points of contact with the card 9.

In order to optimise the heat exchange between the wall 21 and the card 9, a thermally conductive filler material 24 is interposed between the card 9 and the central portion 2, that is, between the card 9 and the face 21*a* of the wall 21.

The material 24 may be of the same type as the material 23, for example the so-called gap-filler or a heat conductive silicone.

Advantageously, since the pump 1 is a pump of the wet rotor type, the liquid moved by the impeller 6 touches all the walls of the central portion 2 of the casing.

The portion 2 is shaped in such a way that at least part of the side walls define gaps in which the liquid circulates which removes heat at least from the central portion 2.

The portion 2 exchanges heat, amongst other things, with the stator and with the electronic card which are thus effectively cooled, indirectly, by the liquid in circulation.

The heat is brought from the windings and from the electronics to the plastic and from there transferred to the liquid.

The pump 1 has a relatively compact overall structure, thanks also to the preferred housing of the stator and the rotor in the central portion of the casing.

For completeness of description, it may be noted that the electronic card, as well as being cooled through the wall 21, is preferably cooled also through the cover 3 which acts as a heat dissipater.

The card 9, and especially the relative electronic components, is brought into contact, by means of suitable electrically insulating materials, with the cover 3, for example made of aluminium or an aluminium alloy, in such a way as to exchange heat with it in a more effective manner.

Figure 7:
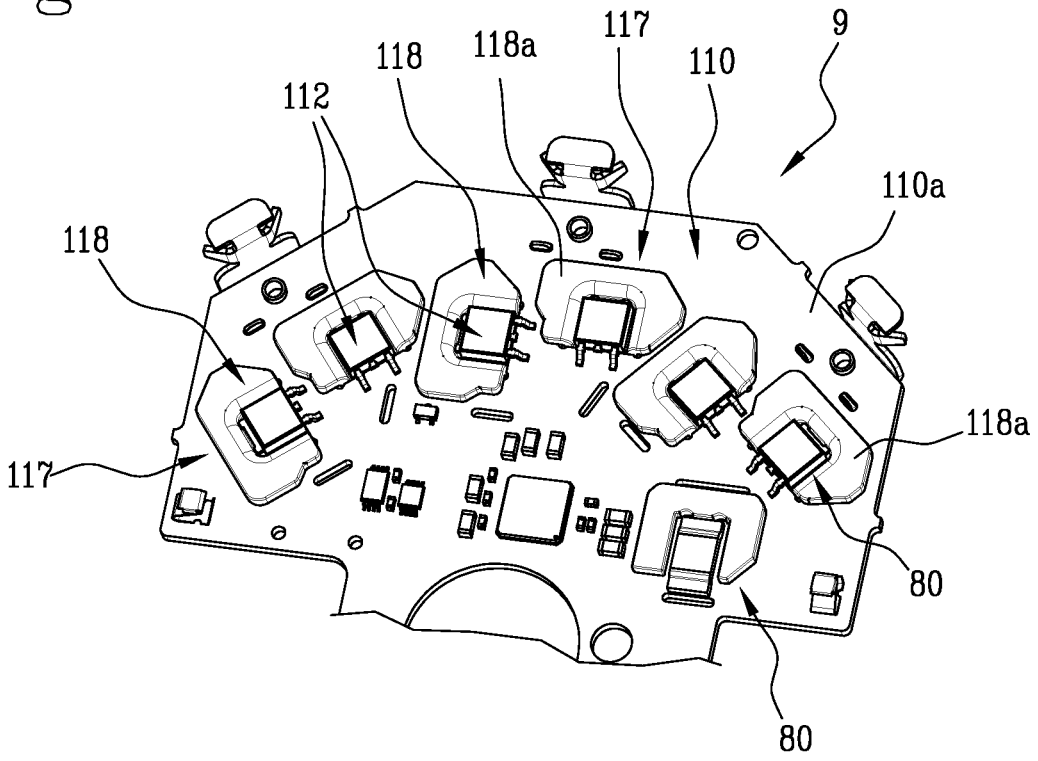
FIG. 7 is suitably interrupted schematic perspective view of an electronic control card of an electric pump according to this invention.
Figure 8:
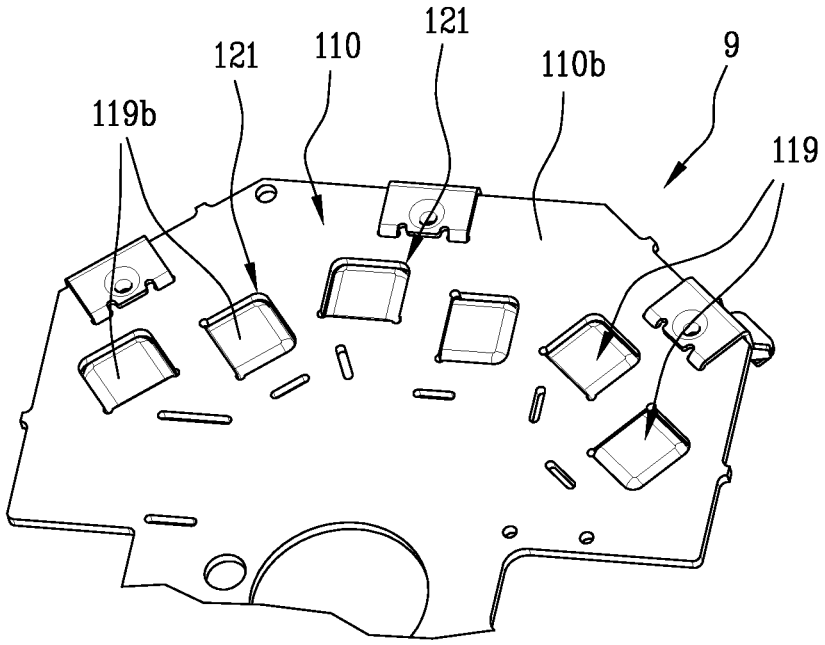
FIG. 8 is a different suitably interrupted schematic perspective view of the electronic control card of FIG. 7.

A preferred embodiment of the card 9 is illustrated in FIGS. 7 and 8.

The electronic module 9 comprises a plurality of electronic components, including, for example, surface-mount electronic components 80, also known as SMD electronic components, and pin-through-hole electronic components, also known as PTH electronic components.

The electronic module 9 of the pump 1 illustrated for example comprises a printed circuit board 110.

The printed circuit board 110 is generally known by its acronym "PCB".

In the embodiment described in the example, the electronic components 80 are mounted on the same side 110*a* of the printed circuit board 110, also defined as the component side of the printed circuit board 110.

The components side 110*a* of the printed circuit 110 defines a first side or upper face 110*a* of the electronic module 9.

The electronic components 80 are positioned on the first side 110*a* of the electronic module 9 so that they face towards the cover 3 and are facing it.

The electronic components "SMD" 80 comprise MOSFETs 112 which are "SMD" electronic power components.

The MOSFETs 112, which are substantially of known type and are therefore not described in detail here, are electronic components having a case with a substantially parallelepiped shape and have a plastic part, and a base at least partly metallic.

The MOSFETS 112 embody, in this description, electronic power components which are equipped with a base or tab.

The aspects of the invention referred to the MOSFETs are fully valid for any electronic power component having a respective base.

Generally speaking, the base is a packaging for supporting a chip of the electronic component and has both a mechanical function and a thermal and electrical function.

Each MOSFET 112 has a defined height h1 which in the solution shown in the example extends in a direction parallel to the axis of rotation R.

More in general, the height h1 extends in a direction which is substantially perpendicular to the printed circuit 110.

Each MOSFET 112 is equipped with respective power connection terminals.

According to an aspect of the invention, the electronic module 9 comprises a plurality of elements for transferring heat or "heat transfer devices" 117 each connected to at least one respective electronic component 80, such as the MOSFETs 112.

As illustrated, each MOSFET 112 may be connected to a corresponding heat transfer device 117.

The heat transfer device 117 is preferably an element with a high thermal and electrical conductivity of the "SMD" type, that is, "Surface Mount Device".

According to an embodiment, the heat transfer devices 117 are associated with one or more electronic power components, in particular with a respective MOSFET 112, to increase the surface area for heat exchange and favour the transmission of the heat generated inside the component towards the cover 3 which acts as a heat dissipater.

Each heat transfer device 117 is soldered to the component side 110*a* of the printed circuit board 110, in such a way as to be facing towards the cover 3; for simplicity of description, reference is made below to a single heat transfer device 117 the heat transfer devices 117 preferably being all equal to each other.

The heat transfer device 117 comprises an upper portion 118 and a base portion 119 connected to the upper portion 118.

In accordance with an aspect of the invention when the heat transfer device 117 is mounted in the printed circuit board 110, the upper portion 118 extends or projects from the printed circuit board 110 towards the cover 3 which acts as a heat dissipater.

The upper portion 118 projects from the printed circuit board 110 on the same side 110*a* of the respective MOSFET 112, more specifically on the same side 110*a* of the case of the MOSFET 112.

When the heat transfer device 117 is mounted in the printed circuit board 110, the base portion 119 is positioned in the printed circuit board 110 at least partly underneath the respective electronic component, in particular a MOSFET 112.

Preferably, the base portion 119 has plan dimensions which are greater than or equal to the plan dimensions of the MOSFET 112, in such a way as to maximise the contact surface between MOSFET and heat transfer device.

According to embodiments not illustrated, the base portion 119 is sized to receive a number of MOSFETs 112 greater than one, for example, two or three.

In other words, the base portion is divided into as many pads as there are electronic components to be coupled to the heat transfer device 117 and the upper portion 118 is shaped in such a way as to be maximised compatibly with the limits of the size of the electronic module.

The base portion 119 forms, at least partly, a preferential path for the heat generated by the electronic component 112 from the base of the electronic component 112 to the cover 3 which acts as heat dissipater.

In use, the heat generated by the MOSFET 112 flows mostly from the base of the MOSFET to the base portion 119 of the heat transfer device 117 and from there to the upper portion 118.

The upper portion 118 is located in thermal contact with the cover 3 which acts as heat dissipater, in such a way that the heat can be dissipated outside the pump 1.

As illustrated, the heat transfer device 117 comprises the base portion 119 from which projects in a cantilever fashion the upper portion 118.

The upper portion 118 surrounds the lower portion 119, leaving free a side at the connection terminals of the electronic component 112.

The portion 119 is connected on three sides to the upper portion 118 maximising the heat exchange surface.

The portion 119 is substantially flat and is designed to receive the MOSFET 112 or several MOSFETs 112; for convenience of description reference is also made to a single MOSFET 112.

The portion 119 has a flat upper face, on which may be positioned the MOSFET 112 with the base resting on the upper face, and a lower face 119*b*.

The upper portion 118 extends preferably as a flap, to which explicit reference will be made without thereby limiting the scope of the invention, from the base portion 119.

The upper portion 118 or flap of the heat transfer device 117 has an upper face 118*a* and a lower face.

The flap 118 extends parallel to the base portion 119 and, according to an aspect of the invention, its shape depends on the free space in the electronic module 9.

Generally speaking, an attempt is made to maximise the surface of the flap 118 since it is designed to exchange heat with the cover 3 which acts as a heat dissipater.

In the example of FIG. 7, the flap 118 surrounds the MOSFET 112 on three sides and each MOSFET 12 is surrounded on three sides by the upper portion 118.

In embodiments not illustrated, the MOSFETs 112 may be close to each other on the base portion 119 with the upper portion 118 which surrounds only externally the electronic components.

It should be noted that preferably, a solution with several electronic components 112 soldered on a same heat transfer device 117 can be actuated when an electrical connection between the bases of the separate electronic components is desired.

In general, the lower face of the upper portion 118 of the heat transfer device is substantially coplanar with the upper face of the base portion 119.

Since, as described in more detail below, the upper face of the base portion 119 of the heat transfer device 117 is preferably coplanar with the upper face 110*a* of the printed circuit board 110, the relative positioning of the lower face of the upper portion 118 and of the upper face of the base portion, that is, the shape of the heat transfer device 117, takes into account the thickness of a solder paste, not illustrated, normally provided under the upper portion 118 for fixing the heat transfer device 117 to the printed circuit board 110.

The paste usually has a thickness of approximately 2 tenths of a millimetre.

In that way, when the heat transfer device 117 is soldered to the printed circuit board 110, in particular to the relative first edge 110*a*, by the lower face of the flap 118, the upper face of the base portion 119 is substantially coplanar with the side 110*a* of the printed circuit 110.

Preferably, the heat transfer device 117 has a portion for connecting the base portion 119 with the flap 118*a*.

In an embodiment, the upper portion 118 and the base portion 119 of the heat transfer device 117 are soldered to each other and a soldering defines, in practice, the connecting portion between the two portions 118 and 119.

In a preferred embodiment illustrated in the accompanying drawings, the upper portion 118 and the base portion 119 are made in a single body.

The heat transfer device 117 is defined by a single element comprising the upper portion 118 and the base portion 119 for example joined by the joining portion.

If the heat transfer device 117 is made as a single body it may be made by drawing and/or pressing and cutting from a tinned sheet of thermally conductive material.

The printed circuit board 110 comprises a seat 121 for the base portion 119 of the heat transfer device 117 whilst, as mentioned above, the upper portion 118 is above of the printed circuit board 110, from the side of the components 112.

As illustrated, for example in FIG. 8, the base portion 119 of the heat transfer device 117 is inserted in the respective seat 121.

Preferably, the seat 121 is in the form of a through hole in the printed circuit board 110.

When the heat transfer device is mounted in the printed circuit board 110 it should be noted that the flap 118 has the lower face substantially coplanar to the upper face 110*a* of the printed circuit board 110, except for the thickness of the solder paste, not illustrated, between the heat transfer device and the PCB.

The flap 118 is connected to the printed circuit 110 through its lower face 118*b* and the heat transfer device 117 is connected to the printed circuit through the flap 118.

In a preferred embodiment, the base portion 119 has the lower 119*b* face coplanar with a second side 110*b* or lower face of the printed circuit board 110 in such a way as to abut directly against the above mentioned wall 21, in particular against the relative flat face 21*a*, on the opposite side relative to the rotor 8.

In that way, the face 119*b* is also used to remove heat from the MOSFET 112 through the wall 21.

In an embodiment not illustrated, the base portion 119 of the heat transfer device can be incorporated in the printed circuit 110.

The printed circuit 110 can be produced with a thermally conductive insert substantially at a pad for positioning and fixing the MOSFET.

In this case, during the assembly of the electronic module, the upper portion 118 of the heat transfer device 117 and the MOSFET 112 are soldered to the lower portion 119 incorporated in the printed circuit 110.

Each heat transfer device 117 has a height h2 above the printed circuit 110, defined, in the solution shown in the example, in a direction parallel to the axis of rotation R.

In general, the height h2 extends in a substantially perpendicular direction to the printed circuit 110.

The value h2 also identifies the thickness of the flap 118 which, in the embodiment illustrated by way of example, corresponds to the thickness of the base portion 119 of the heat transfer device 117.

Since the MOSFETs 112 may be brought into direct contact with the cover 3 through the above-mentioned plastic part of their case (therefore without any electrical short-circuit problems), the pump 1 comprises a second layer of thermally conductive and electrically isolating filler material interposed between the heat transfer device 117 and the heat dissipater 3.

The filler material may be for example in the form of a paste interposed at least between the heat transfer device 117 and the cover 3.

Since between the MOSFET 112 and the heat transfer device 117 there is direct contact at the base, the interposing of the layer of thermally conductive and electrically isolating filler material, for example the so-called "thermally conductive gap filler", with a thickness between the values of the heights h1-h2, between the heat transfer device 117 and the cover 3 creates a preferential path for the transfer of the heat dissipated by the MOSFET 112.

The heat transfer device 117 acts as a "thermal joint", that is, a means favouring the transfer of the heat generated by the MOSFET 112 towards the cover 3.

Each heat transfer device 117 has the upper face 118*a* of the flap 118 facing towards the cover 3; the upper face 118*a* defines the heat exchange surface by which the heat transfer device 117 transfers most of the heat generated by the MOSFET 112 to the cover 3 which, as already mentioned, acts in turn as a heat dissipater.

The area of the surface 118*a* is made as large as possible, as mentioned, within the design constraints for size, so as to minimise the resistance to the passage of heat.

A part of the heat generated by each MOSFET 112 is transferred to the cover 3 also by the case which is facing and, preferably, in mechanical contact with the cover 3.

However, most of the heat generated by each MOSFET 112 is transferred to the cover 3 by the corresponding heat transfer device 117 or removed from the base portion 119 through the wall 21.

Preferably, the height h2 of each heat transfer device 117, in particular of the upper portion 118, is less than the height h1 of the case of the respective MOSFET 112, so that the MOSFETs 112 act as spacer elements separating the cover 3 from the heat transfer devices 117, thus preventing any short circuits which could occur following direct contact between the heat transfer devices 117 and the cover 3 of the pump 1.

Alternatively, if the height h2 of the heat transfer device 117, in particular of the portion 118 on the components side 110*a*, is greater than the height h1 of the case of the MOSFET 112, an alternative arrangement for preventing the short circuits resulting from direct mechanical contact between the heat transfer device 117 and the cover 3 would be to insert a thermally and electrically conductive material, such as "Sil-Pad", between the cover 3 and the upper face 118*a* of the heat transfer device 117.

For completeness it should be noted that in the embodiment illustrated for example, the pump 1 comprises a pin 25, fixed into a corresponding socket 26 made in the bottom wall 21, on the side opposite the face 21*a*, on which the rotor turns 8.

The invention claimed is:

1. An electric pump for moving a liquid, comprising:

a case comprising:

a central portion including a first compartment and a second compartment which are separate from each other;

a front cover and a rear cover, the front cover including an inlet and an outlet for the liquid, joined to the central portion, the second compartment being in fluid communication with an inside of the front cover;

an electric motor comprising:

a stator including a plurality of poles housed in the first compartment, a rotor, coaxial with the stator, housed in the second compartment, an electronic card for supplying the stator, the electronic card at least partly housed in the rear cover;

an impeller connected to the rotor and configured to be rotated by the rotor, the impeller housed at least partly in the front cover, wherein the central portion comprises a plurality of walls delimiting a plurality of gaps in fluid communication with the second compartment and with the inside of the front cover such that the liquid also circulates in the gaps, the walls being at least partly facing the stator such that the liquid circulating in the gaps removes heat from the stator;

wherein the central portion comprises a first annular wall, which delimits externally part of the case, and a second annular wall delimiting with the first annular wall an annular gap surrounding at least partly the stator and in fluid communication with the second compartment and with the inside of the front cover;

wherein the central portion comprises a plurality of seats each for a corresponding pole of the stator, each seat being delimited by a respective first side wall, by a second side wall, by a third side wall, by a fourth side wall and by a bottom wall of the plurality of walls, the plurality of seats defining at least partly the first compartment;

wherein the first side walls of first seats and second side walls of second seats adjacent to the first seats define between the poles of the stator, the plurality of gaps in fluid communication with the second compartment to provide a radial flow of the liquid with the annular gap and the second compartment;

wherein the fourth side walls define with the first annular wall the annular gap.

2. The pump according to claim 1, wherein the third side walls of the seats delimit at least partly the second compartment, the third side walls being positioned in an air gap of the electric motor.

3. The pump according to claim 1, wherein the central portion comprises a bottom wall of the second compartment, the electronic card being abutted against the bottom wall of the second compartment on a side opposite the rotor.

4. The pump according to claim 1, comprising a thermally conductive filler material interposed between the electronic card and the central portion.

5. The pump according to claim 1, comprising a second thermally conductive filler material interposed between the stator and the central portion.

6. The pump according to claim 1, wherein the central portion is made of a molded plastic material.

7. The pump according to claim 6, wherein the plastic material comprises polyphenylene sulphide (PPS) with graphite filler.

8. The pump according to claim 6, wherein the plastic material comprises polyphenylene sulphide (PPS) with ceramic filler.

9. The pump according to claim 1, wherein the central portion is made of plastic material comprising polyphenylene sulphide (PPS) with filler material.

10. The pump according to claim 1, wherein the central portion is made of plastic material having an average thermal conductivity in an order of 10 W/(m·° K).

11. The pump according to claim 1, wherein the electronic card is thermally connected with the rear cover to exchange heat with the rear cover and is electrically insulated from the rear cover by an insulating material.

12. The pump according to claim 1, comprising a thermally conductive filler material interposed between the electronic card and a bottom wall of the second compartment against which the electronic card abuts.

13. A method for moving a liquid, comprising:

providing an electric pump for moving the liquid, the electric pump comprising:

a case comprising:

a central portion including a first compartment and a second compartment which are separate from each other;

a front cover and a rear cover, the front cover including an inlet and an outlet for the liquid, joined to the central portion, the second compartment being in fluid communication with an inside of the front cover;

an electric motor comprising:

a stator including a plurality of poles housed in the first compartment, a rotor, coaxial with the stator, housed in the second compartment, an electronic card for supplying the stator, the electronic card at least partly housed in the rear cover;

an impeller connected to the rotor and configured to be rotated by the rotor, the impeller housed at least partly in the front cover, wherein the central portion comprises a plurality of walls delimiting a plurality of gaps in fluid communication with the second compartment and with the inside of the front cover such that the liquid also circulates in the gaps, the walls being at least partly facing the stator such that the liquid circulating in the gaps removes heat from the stator;

wherein the central portion comprises a first annular wall, which delimits externally part of the case, and a second annular wall delimiting with the first annular wall an annular gap surrounding at least partly the stator and in fluid communication with the second compartment and with the inside of the front cover;

wherein the central portion comprises a plurality of seats each for a corresponding pole of the stator, each seat being delimited by a respective first side wall, by a second side wall, by a third side wall, by a fourth side wall and by a bottom wall of the plurality of walls, the plurality of seats defining at least partly the first compartment;

wherein the first side walls of first seats and second side walls of second seats adjacent to the first seats define between the poles of the stator, the plurality of gaps in fluid communication with the second compartment to provide a radial flow of the liquid with the annular gap and the second compartment;

wherein the fourth side walls define with the first annular wall the annular gap;

rotating the impeller with the rotor to cause the radial flow of the liquid through the plurality of gaps and with the annular gap and the second compartment.

* * * * *